US006505984B2

(12) United States Patent
Smith et al.

(10) Patent No.: US 6,505,984 B2
(45) Date of Patent: Jan. 14, 2003

(54) CRAYON WITH ERASER

(75) Inventors: David S. Smith, Hopewell, NJ (US); Douglas A. Brand, Easton, PA (US); Vito Niosi, Easton, PA (US); Robert S. Volk, Easton, PA (US)

(73) Assignee: Binney & Smith Inc., Easton, PA (US)

( * ) Notice: Subject to any disclaimer, the term of this patent is extended or adjusted under 35 U.S.C. 154(b) by 0 days.

(21) Appl. No.: 09/843,537

(22) Filed: Apr. 27, 2001

(65) Prior Publication Data

US 2002/0159818 A1 Oct. 31, 2002

(51) Int. Cl.[7] ..... B43K 25/00

(52) U.S. Cl. ..... 401/52; 401/195; 15/424; D19/53

(58) Field of Search ..... 401/52, 195, 49, 401/88; 15/105.51, 424–434; D19/36, 53

(56) References Cited

U.S. PATENT DOCUMENTS

| | | | | | |
|---|---|---|---|---|---|
| 144,337 | A | * | 11/1873 | Illfelder | 15/424 |
| 384,383 | A | * | 6/1888 | Myers | 401/52 |
| 426,950 | A | | 4/1890 | Negraval | |
| 1,513,439 | A | | 10/1924 | Wickers | |
| 1,750,912 | A | | 3/1930 | Towne | |
| 1,985,307 | A | * | 12/1934 | Boast | 15/424 |
| 4,856,693 | A | | 8/1989 | Kageyama et al. | |
| 4,991,985 | A | | 2/1991 | Laipply | |
| 5,022,774 | A | | 6/1991 | Kageyama et al. | |
| 5,072,483 | A | | 12/1991 | Durand | |
| 5,236,270 | A | | 8/1993 | Kageyama et al. | |
| 5,356,232 | A | * | 10/1994 | Skinner | 401/52 |
| 5,432,973 | A | | 7/1995 | Wagner et al. | |
| 5,855,442 | A | | 1/1999 | Keller | |
| 5,871,294 | A | | 2/1999 | Turner | |
| 5,957,603 | A | | 9/1999 | Bell | |
| 6,004,057 | A | | 12/1999 | Fulop | |
| 6,019,535 | A | | 2/2000 | Turner | |
| 6,048,121 | A | | 4/2000 | Carver | |
| 6,056,468 | A | | 5/2000 | Niewiadomski | |
| 6,290,413 | B1 | * | 9/2001 | Wang | 401/30 |

OTHER PUBLICATIONS

Three photographs of Kelsa Marker by Mitsubishi, available Jan. 2000.

Three photographs of Erasable Marker by Avery, available Jan. 2000.

* cited by examiner

*Primary Examiner*—David J. Walczak
(74) *Attorney, Agent, or Firm*—Leydig, Voit & Mayer, Ltd.

(57) ABSTRACT

The crayon assembly includes a crayon and an eraser. The crayon is made of a material which can make a mark on paper and which is capable of being erased from paper. The crayon assembly may also include a label. The crayon may include an attachment portion which may be a pocket. The eraser may include an attachment portion which may be a post. The post corresponds to the pocket. The attachment portions may have different shapes and/or cross sections. The crayon may be connected to the eraser by molding. In other embodiments the eraser may be connected to the crayon by an adhesive, by a ferrule or by other configurations.

28 Claims, 10 Drawing Sheets

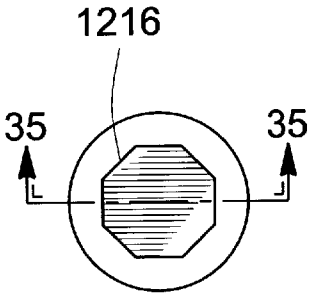
FIG. 28
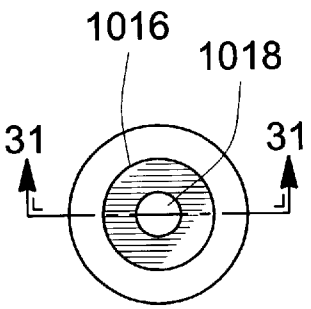
FIG. 30
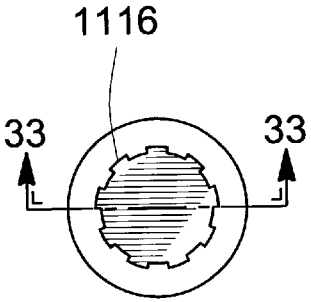
FIG. 32
FIG. 34
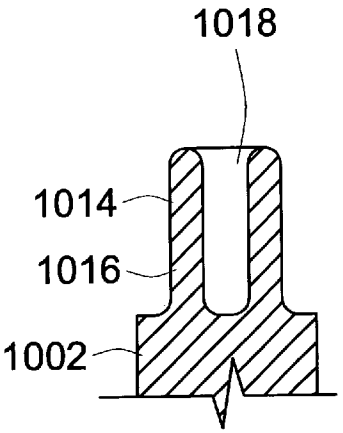
FIG. 31
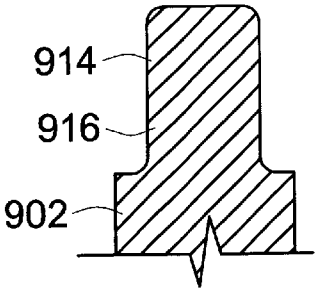
FIG. 29
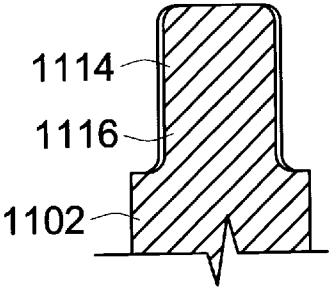
FIG. 33
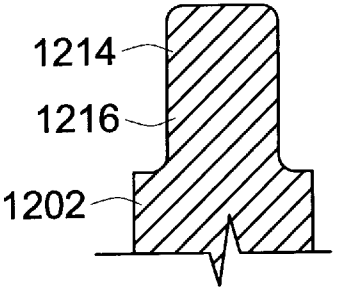
FIG. 35

CRAYON WITH ERASER

FIELD OF THE INVENTION

This invention relates generally to the field of writing instruments with erasers, and more particularly to crayons with erasers.

BACKGROUND OF THE INVENTION

Children use crayons to make drawings and to fill in the drawings in coloring books. One of the difficulties with crayons is that the mark cannot be erased. If the child makes a mistake using the crayon, the child is not able to remove the mark from the paper. Therefore, there is a need for a crayon which can be erased from paper.

Furthermore, if the child was provided with an erasable crayon, the child would also need an eraser to erase any unwanted crayon markings from the paper. A separately provided eraser could become lost or misplaced when the child wishes to use the erasable crayon. Consequently, the child would not be able to erase the unwanted marks on the paper. Therefore, there is a need for an erasable crayon which includes an eraser.

The invention provides such a device. These and other advantages of the present invention, as well as other inventive features, will be apparent from the description of the invention provided herein.

SUMMARY OF THE INVENTION

The crayon assembly includes a crayon and an eraser. The eraser is molded onto the crayon. The crayon is made of a material which can make a mark on paper and which is capable of being erased from paper. The crayon assembly may also include a label. The crayon may include an attachment portion which may be a pocket. The eraser may include an attachment portion which may be a post. The post corresponds to the pocket. The attachment portions may have different shapes and/or cross sections.

The crayon may be connected to the eraser by molding. In other embodiments the eraser may be connected to the crayon by an adhesive, by a ferrule or by other configurations.

Other advantages of the invention will become apparent upon reading the following detailed description and upon reference to the drawings.

BRIEF DESCRIPTION OF THE DRAWINGS

FIG. 28 is a top view of another embodiment of a crayon;

FIG. 29 is a cross-sectional view taken along lines 29—29 of FIG. 28;

FIG. 30 is a bottom view of another embodiment of a crayon;

FIG. 31 is a cross-sectional view taken along line 31—31 in FIG. 30;

FIG. 32 is a bottom view of another embodiment of a crayon;

FIG. 33 is a cross-sectional view taken along line 33—33 in FIG. 32;

FIG. 34 is a bottom view of another embodiment of a crayon; and

FIG. 35 is a cross-sectional view taken along line 35—35 in FIG. 34.

DESCRIPTION OF THE INVENTION

Figure 1:
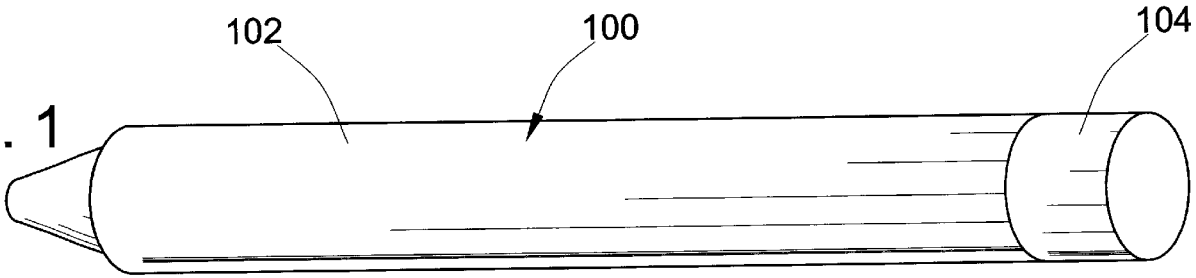
FIG. 1 is a perspective view of the crayon with an eraser according to an embodiment of the present invention.
Figure 2:
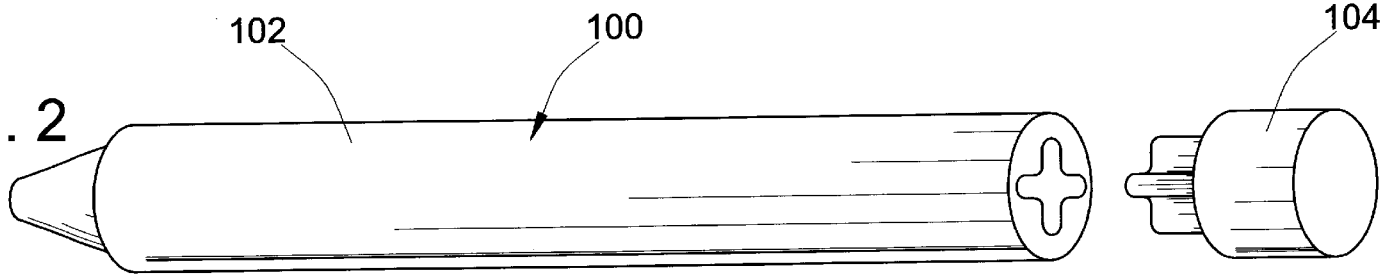
FIG. 2 is an exploded view of the crayon and eraser.
Figure 3:
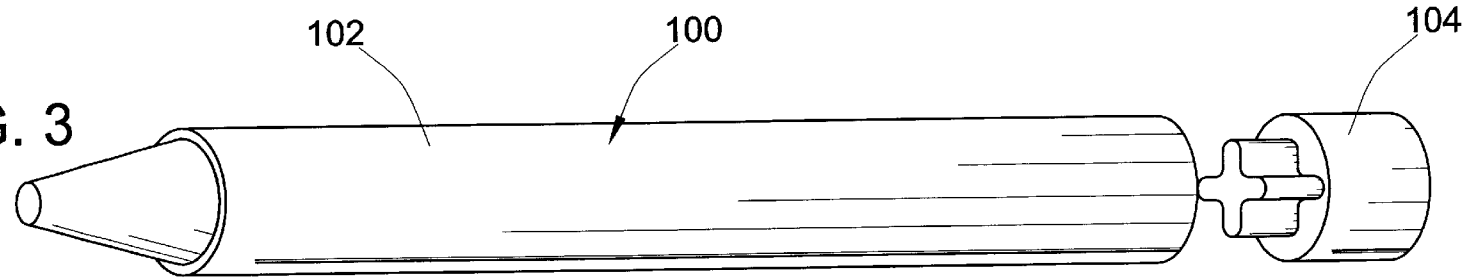
FIG. 3 is an exploded view of the crayon and eraser.
Figure 4:
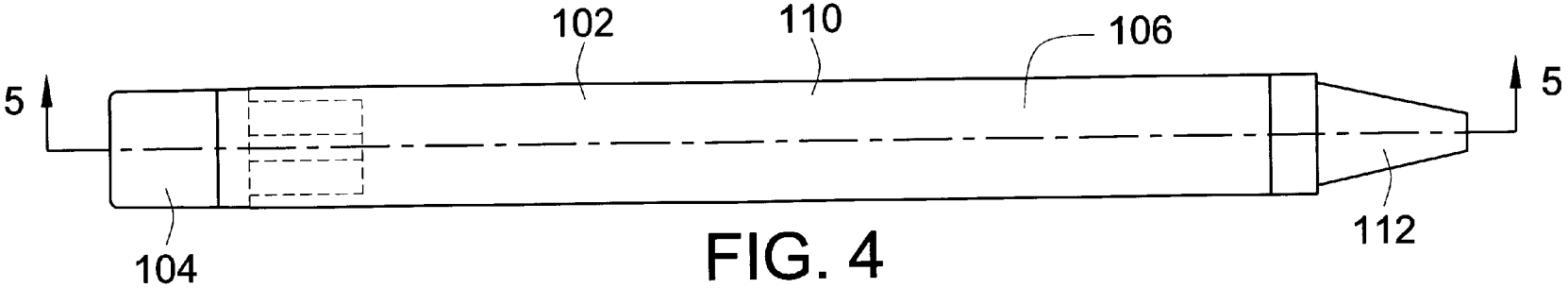
FIG. 4 is a front view of the crayon and eraser.
Figure 5:
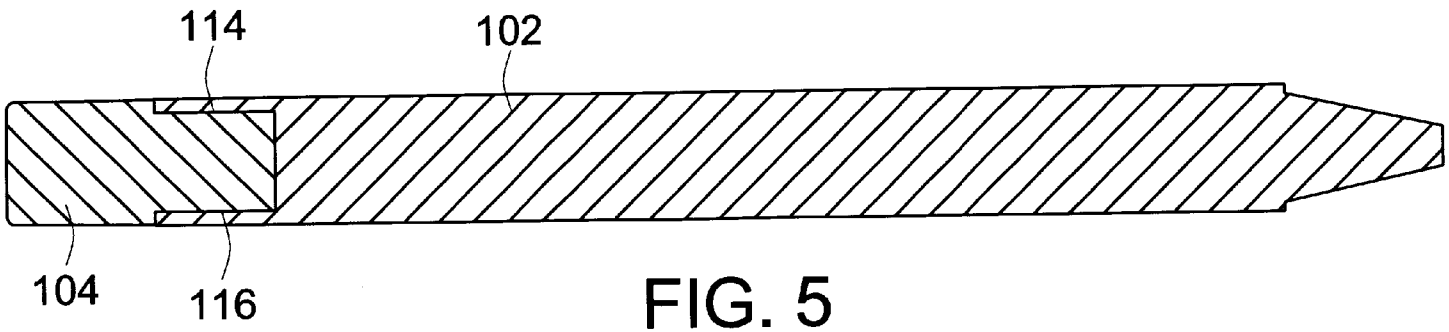
FIG. 5 is a cross-sectional view of the crayon and eraser taken along the line 5—5 in FIG. 4.

A crayon assembly including a crayon and an eraser constructed in accordance with the teachings of this invention is illustrated in FIG. 1. The crayon assembly 100 includes a crayon 102 and an eraser 104. The eraser 104 is molded onto the crayon 102 as will be described in a later section herein. As shown in FIG. 4, the crayon assembly 100 may also include a label 106. The label 106 will identify the manufacturer of the crayon, the color of the crayon and other information.

Referring to FIG. 4, the crayon 102 includes a cylindrical body 110, a conical tip 112 and an attachment portion 114. In this embodiment, the attachment portion 114 is a pocket 116. In other embodiments, the attachment portion 114 may have other configurations including a post configuration which will be discussed in a later section herein.

Figure 7:
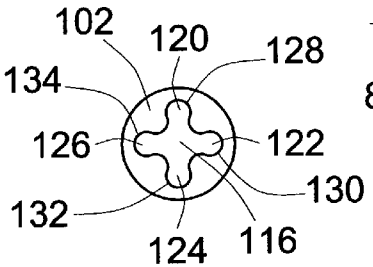
FIG. 7 is a bottom view of the crayon in FIG. 6.

Referring to FIG. 7, the pocket 116 has a cross-section which is shaped like an arithmetic "plus sign". Specifically, the pocket 116 includes four recesses 120, 122, 124, 126 which are at 90° angles to each other. The recesses 120, 122, 124, 126 include rounded end surfaces 128, 130, 132, 134, respectively. In other embodiments, the pocket may include one, two, three, five, six or more recesses.

Figure 6:
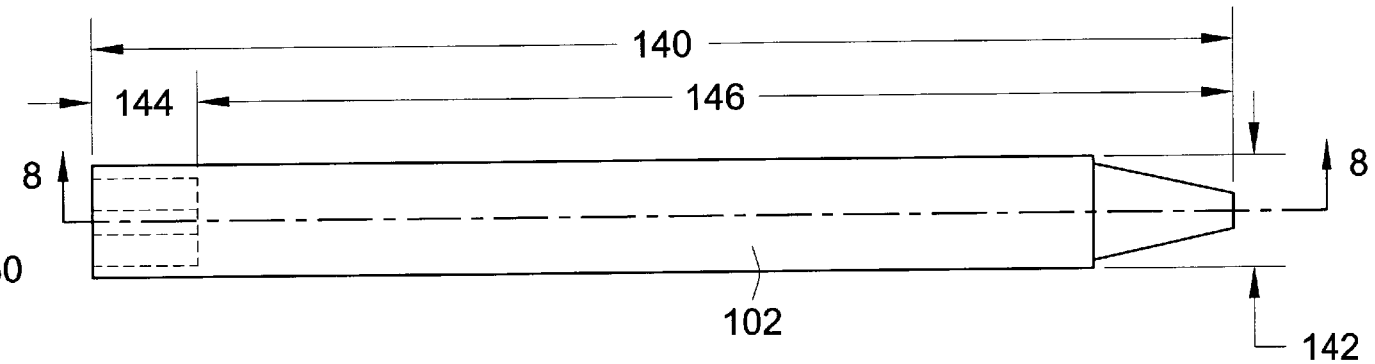
FIG. 6 is a side view of the crayon in FIG. 4.

Referring to FIG. 6, the crayon 102 may have the following dimensions. The crayon 102 has a length 140 of approximately 3.25 inches and a diameter 142 of approximately 0.32 inches. The attachment portion 114 has a length 144 of approximately 0.30 inches. The length 146 is approximately 2.95 inches. The length 140 may have a range from 2 to 6 inches. The diameter 142 may have a range from 0.3 to 0.6 inches. The length 144 may have a range from 0.3 to 0.4 inches. The length 146 may have a range from 1.6 to 5.7 inches.

Figure 9:
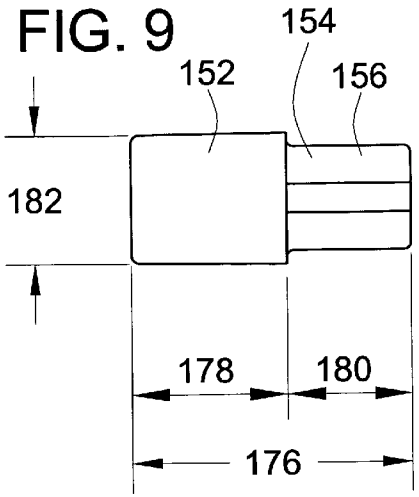
FIG. 9 is a side view of the eraser in FIG. 4.
Figure 10:
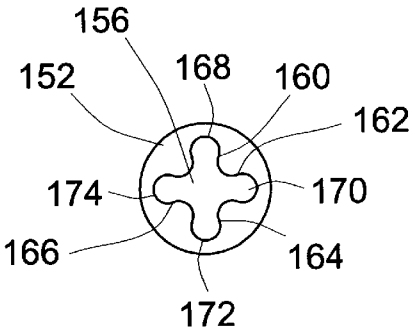
FIG. 10 is a top view of the eraser in FIG. 9.

Referring to FIGS. 9 and 10, the eraser 104 includes a body 152 and an attachment portion 154. In this embodiment, the attachment portion 154 is a post 156. The post 156 has a cross-section configuration like an arithmetic "plus sign". Specifically the post 156 includes four fins 160, 162, 164, 166 which are at 90° to each other. The fins 160, 162, 164, 166 have rounded end surfaces 168, 170, 172, 174, respectively. The post 156 corresponds to the pocket 116. In other embodiments, the post may have one, two, three, five, six or more fins.

The eraser 104 may have the following dimensions. The length 176 is approximately 0.675 inches. The length 178 of the body is approximately 0.375 inches. The length 180 of the attachment portion is approximately 0.30 inches. The diameter 182 of the body is approximately 0.315 inches. The length 176 may have a range from 0.5 to 1 inches. The length 178 may have a range from 0.1 to 0.4 inches. The length 180 may have a range from 0.1 to 0.4 inches. The diameter 182 may have a range from 0.3 to 0.6 inches.

Figure 12:
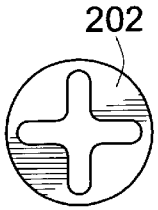
FIG. 12 is a bottom view of the crayon in FIG. 11.
Figure 11:
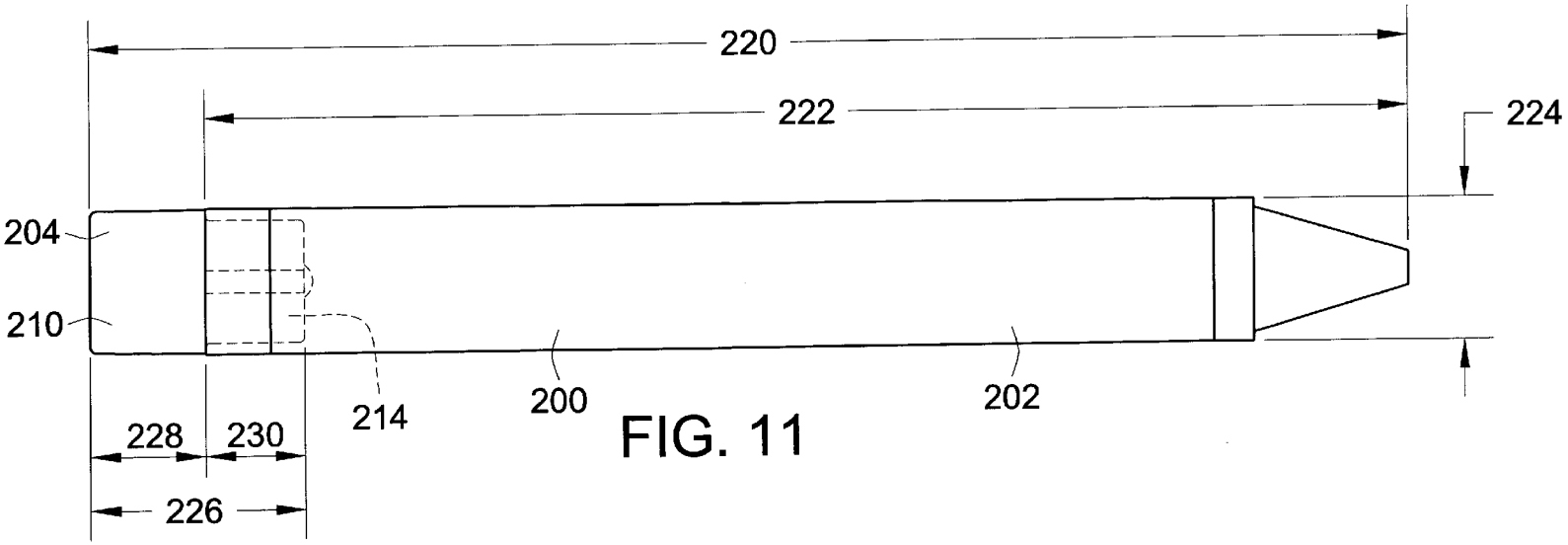
FIG. 11 is a side view of another embodiment of a crayon and eraser.

Referring to FIGS. 11 and 12, another embodiment of crayon assembly 200 is shown. This embodiment is longer than the embodiment shown in FIG. 4 and has a larger diameter than the embodiment shown in FIG. 4. Specifically, the crayon assembly 200 includes a length 220 of approximately 4 inches. The crayon 202 has a length 222 of 3.6 inches. The crayon 202 has a diameter 224 of approximately 0.43 inches. The eraser 204 has a length 226 of approximately 0.65 inches. The body 210 of the eraser has a length 228 of approximately 0.35 inches and the attachment portion 214 has a length 230 of approximately 0.3 inches.

Figure 14:
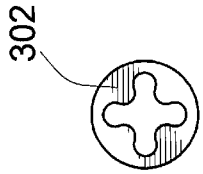
FIG. 14 is a bottom view of the crayon shown in FIG. 13.
Figure 13:
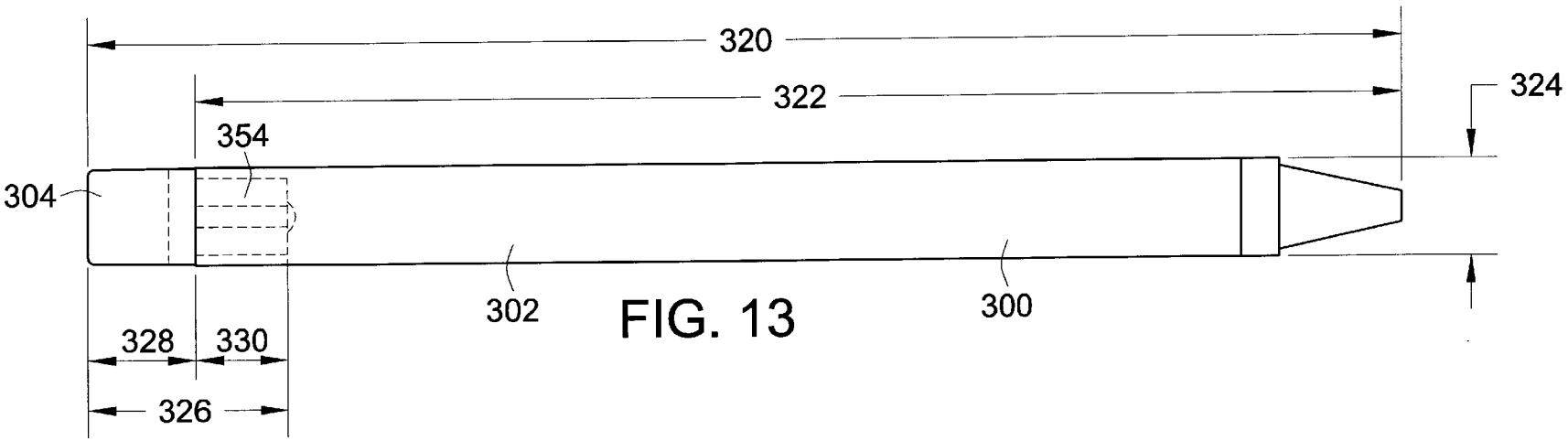
FIG. 13 is a side view of another embodiment of a crayon and eraser.

Referring to FIGS. 13 and 14, another embodiment of crayon assembly 300 is shown. The crayon assembly 300 is longer than the crayon assembly 200 in FIG. 11 and has a diameter similar to the crayon assembly 100 in FIG. 4. Specifically, the crayon assembly 300 includes a crayon 302 and an eraser 304. The crayon 302 assembly has a length 320 of approximately 4.7 inches. The crayon 302 has a length 322 of approximately 4.35 inches. The eraser 304 has a length 326 of approximately 0.65 inches. The body 310 of the eraser has a length 328 of approximately 0.35 inches and the attachment portion 354 has a length 330 of approximately 0.3 inches. The crayon 302 has a diameter 324 of approximately 0.32 inches.

Figure 15:
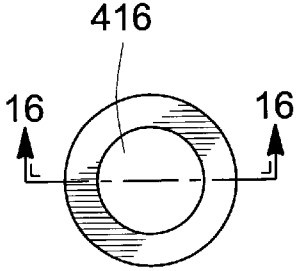
FIG. 15 is a bottom view of another embodiment of a crayon.
Figure 16:
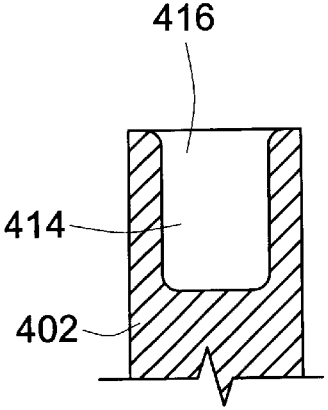
FIG. 16 is a cross-sectional view taken along line 16—16 in FIG. 15.

Referring to FIGS. 15 and 16, another embodiment of an attachment portion for a crayon is shown. The crayon 402 includes an attachment portion 414. The attachment portion 414 has a pocket 416 which has a circular cross section as shown in FIG. 15. The eraser has an attachment portion with a complimentary shape and/or cross section.

Figure 17:
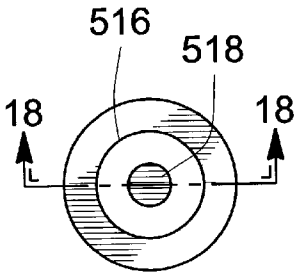
FIG. 17 is a bottom view of another embodiment of a crayon.
Figure 18:
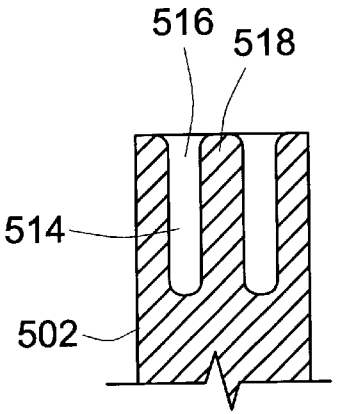
FIG. 18 is a cross-sectional view taken along line 18—18 of FIG. 17.

Referring to FIGS. 17 and 18, another embodiment of an attachment portion for a crayon is shown. The crayon 502 includes an attachment portion 514. The attachment portion 514 has a pocket 516 which has a circular cross section as shown in FIG. 17. The attachment portion 514 also includes a post 518. The eraser has an attachment portion with a complimentary shape and/or cross section.

Figure 19:
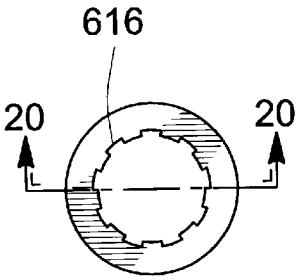
FIG. 19 is a bottom view of another embodiment of a crayon.
Figure 20:
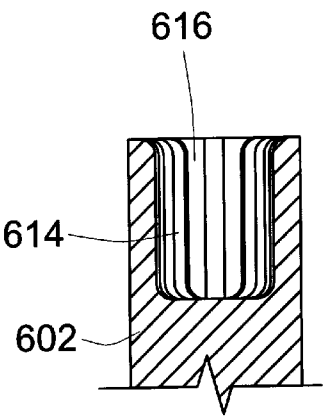
FIG. 20 is a cross-sectional view taken along line 20—20 of FIG. 19.

Referring to FIGS. 19 and 20, another embodiment of an attachment portion for a crayon is shown. The crayon 602 includes an attachment portion 614. The attachment portion 614 has a pocket 616 which has a gear shaped cross section as shown in FIG. 19. The eraser has an attachment portion with a complimentary shape and/or cross section.

Figure 21:
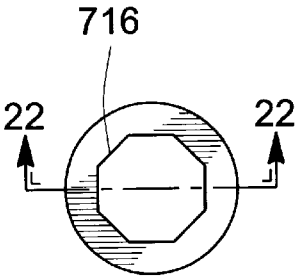
FIG. 21 is a bottom view of another embodiment of a crayon.
Figure 22:
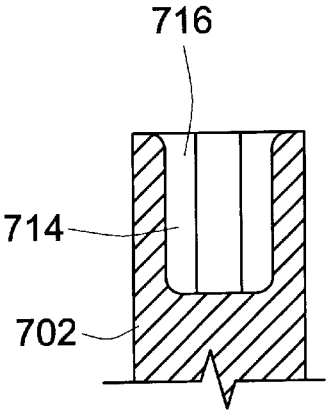
FIG. 22 is a cross-sectional view taken along line 22—22 of FIG. 21.

Referring to FIGS. 21 and 22, another embodiment of an attachment portion for a crayon is shown. The crayon 702 includes an attachment portion 714. The attachment portion 714 has a pocket 716 which has an octagon shaped cross section as shown in FIG. 21. In other embodiments, the attachment portion may be a polygon with any number of sides, including but not limited to, three, four, five, six, seven, nine or more sides. The eraser has an attachment portion with a complimentary shape and/or cross section.

Figure 23:
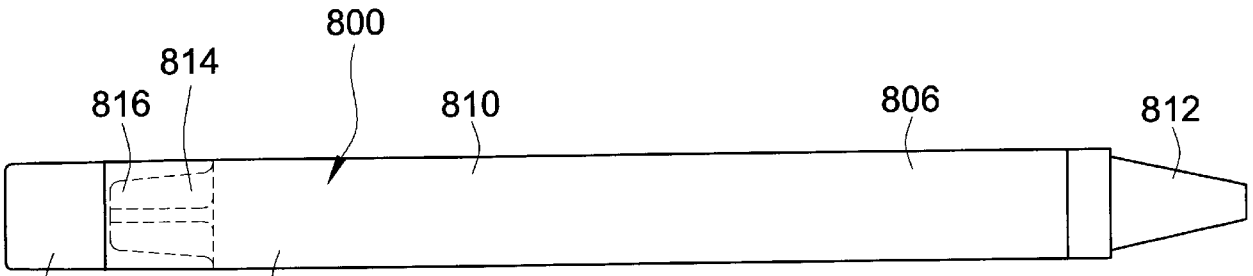
FIG. 23 is a side view of another embodiment of a crayon and eraser.

Referring to FIG. 23, another embodiment of a crayon assembly is shown. The crayon assembly 800 is similar to the crayon assembly in FIG. 4 but has different attachment portions. The crayon assembly 800 includes a crayon 802, an eraser 804 and a label 806.

Figure 24:
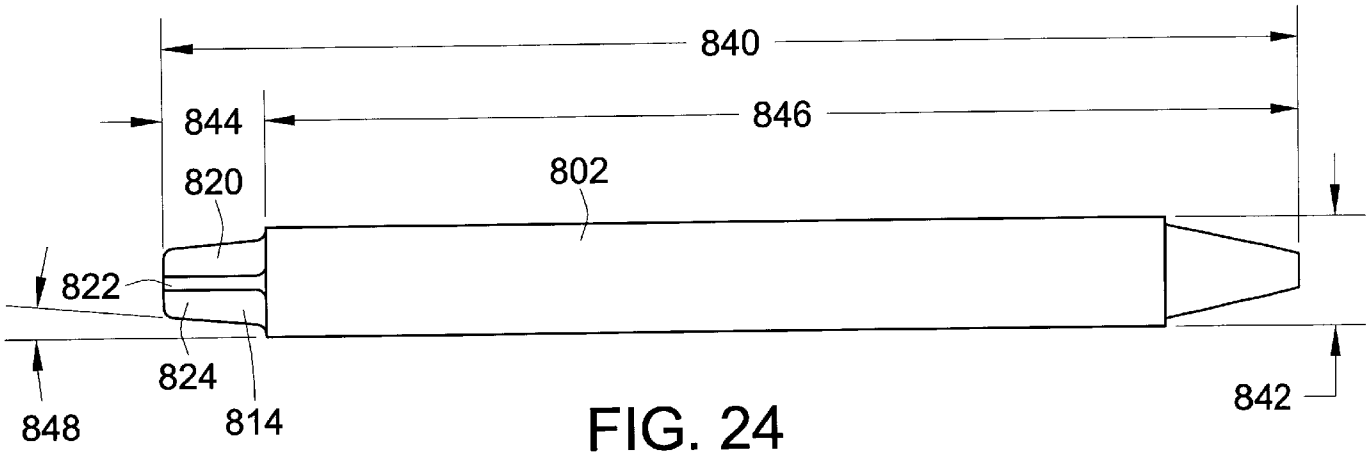
FIG. 24 is a side view of the crayon shown in FIG. 23.
Figure 25:
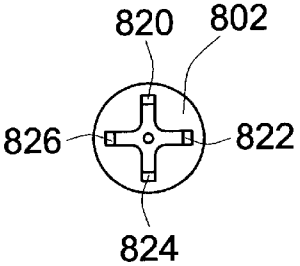
FIG. 25 is a bottom view of the crayon shown in FIG. 24.

Referring to FIG. 23, the crayon 802 includes a cylindrical body 810, a conical tip 812 and attachment portion 814. In this embodiment, the attachment portion 814 is a post 816. Referring to FIGS. 24 and 25, the post has a cross section which is shaped like an arithmetic "plus sign". Specifically, the post 816 includes four fins 820, 822, 824, 826 which are at 90° angles to each other. In other embodiments, the post may have one, two, three, five, six or more fins.

Referring to FIG. 24, the crayon 802 may have the following dimensions. The crayon 802 has a length 840 of approximately 3.3 inches. The length 840 may have a range of 2 to 6 inches. The diameter 842 is approximately 0.32 inches. The diameter 842 may have a range of 0.3 to 0.6 inches. The attachment portion 814 has a length 844 of approximately 0.3 inches. The length 844 may have a range of 0.1 to 0.4 inches. The length 846 is approximately 3.0 inches. The length 846 may have a range of 1.6 to 5.7 inches.

The angle 848 is approximately 5 degrees. The angle 848 may have a range of 0 to 30 degrees.

Figure 26:
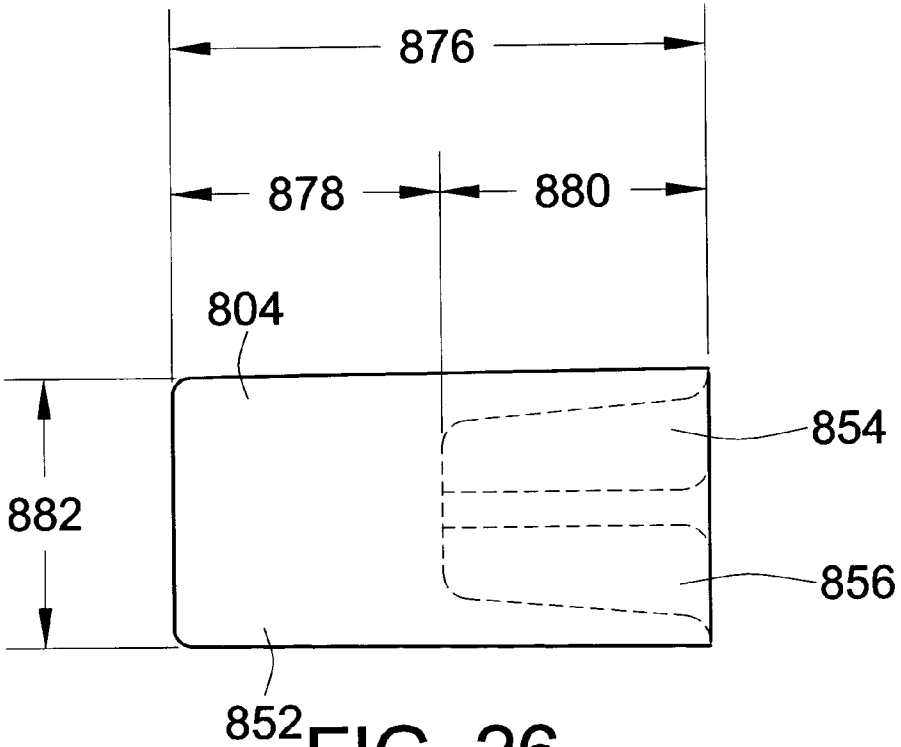
FIG. 26 is a side view of the eraser shown in FIG. 23.

Referring to FIG. 26, the eraser may have the following dimensions. The length 876 is approximately 0.6 inches. The length 876 may have a range from 0.5 to 1.0 inches. The length 878 is approximately 0.3 inches. The length 878 may have a range of 0.1 to 0.4 inches. The length 880 is approximately 0.3 inches. The length 880 may have a range of 0.1 to 0.4 inches. The diameter 882 is approximately 0.32 inches. The diameter 882 may have a range of 0.3 to 0.6 inches.

Figure 27:
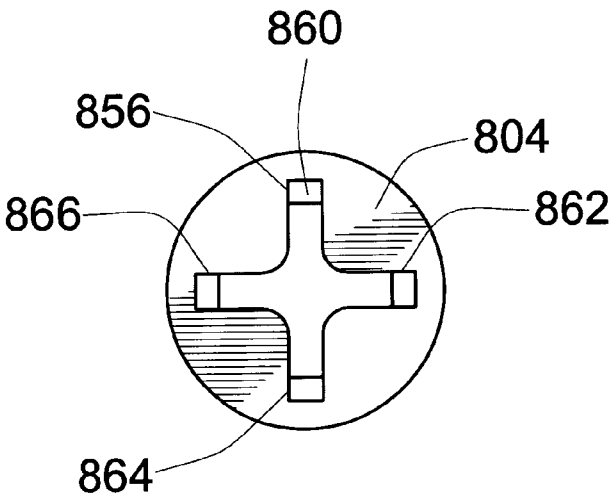
FIG. 27 is a top view of the eraser shown in FIG. 26.

Referring to FIGS. 26 and 27, the eraser 804 includes a body 852 and an attachment portion 854. In this embodiment, the attachment portion 854 is a pocket 856. The pocket 856 has a cross section configuration which is shaped like an arithmetic "plus sign". Specifically, the pocket 856 includes four recesses 860, 862, 864, 866 which are at 90° to each other. The pocket 856 corresponds to the post 816. In other embodiments, the pocket may have one, two, three, five, six or more recesses.

Referring to FIGS. 28 and 29, another embodiment of an attachment portion for a crayon is shown. The crayon 902 includes an attachment portion 914. The attachment portion 914 has a post 916 which has a circular cross section as shown in FIG. 28. The eraser has an attachment portion with a complimentary shape and/or cross section.

Referring to FIGS. 30 and 31, another embodiment of an attachment portion for a crayon is shown. The crayon 1002 includes an attachment portion 1014. The attachment portion 1014 has a post 1016 which has a circular cross section as shown in FIG. 30. The attachment portion 1014 also includes a circular recess 1018. The eraser has an attachment portion with a complimentary shape and/or cross section.

Referring to FIGS. 32 and 33, another embodiment of an attachment portion for a crayon is shown. The crayon 1102 includes an attachment portion 1114. The attachment portion 1114 has a post 1116 which has a gear shaped cross section as shown in FIG. 32. The eraser has an attachment portion with a complimentary shape and/or cross section.

Referring to FIGS. 34 and 35, another embodiment of an attachment portion for a crayon is shown. The crayon 1202 includes an attachment portion 1214. The attachment portion 1214 has a post 1216 which has an octagon shaped cross section as shown in FIG. 34. In other embodiments, the attachment portion may be a polygon with any number of sides, including but not limited to, three, four, five, six, seven, nine or more sides. The eraser has an attachment portion with a complimentary shape and/or cross section.

Figure 8:
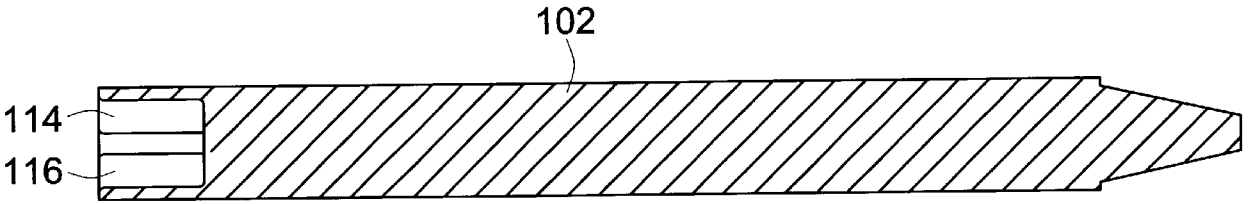
FIG. 8 is a cross-sectional view taken along line 8—8 in FIG. 6.

The crayon assembly 100 may be made in the following manner. Referring to FIG. 4, the crayon assembly 100 is made by using a two part molding process. The crayon 102 and the eraser 104 are molded using an injection molding machine which has a two part mold. The crayon 102 is molded first as shown in FIGS. 6, 7 and 8. The mold is then moved inside the injection molding machine and the eraser 104 is molded onto the end of the crayon 102 as shown in FIG. 4. The crayon assembly 100 is then ejected from the machine.

The crayon assembly 100 may also be molded in the opposite sequence. For example, referring to FIG. 4, the eraser 104 could be molded first and the crayon 102 could be molded onto the eraser 104.

After the crayon assembly 100 has been molded, the label 106 is applied to the crayon assembly 100 and the crayon assembly 100 is packaged with other crayon assemblies 100 into a box or other package.

One of the advantages of molding the eraser onto the crayon is that the eraser 104 is bonded to the crayon 102. In this embodiment, the eraser 104 can withstand a pulling force of at least 10 pounds before the eraser 104 is removed from the crayon 102.

Figure 36:
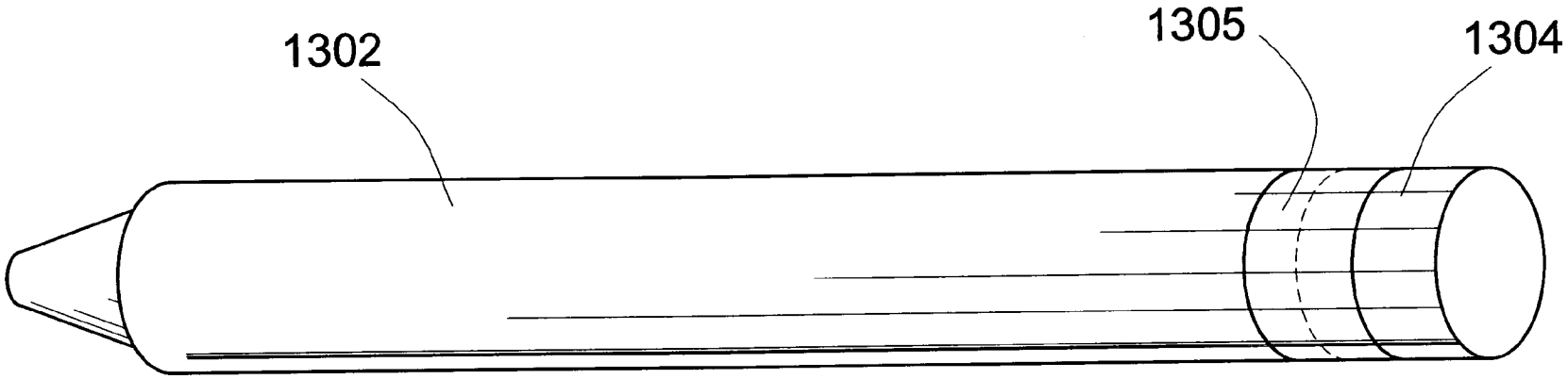
FIG. 36 is a perspective view of another embodiment of a crayon and eraser.

Another advantage of molding the eraser 104 onto the crayon 102 is that an assembly step is eliminated. Specifically, another manufacturing step would be required if the eraser 104 was separately attached to the crayon 102 by an adhesive or a mechanical means. However, in other embodiments, the eraser may be connected to the crayon by an adhesive, by a ferrule 1305 around the eraser 1304 and the crayon 1302 as shown in FIG. 36, by other mechanical configurations, by a fusing process, by spin welding or by ultrasonic welding.

The crayon is made of a material which can make a mark on paper and which is capable of being erased from the paper. One such composition for erasable crayon material is disclosed in PCT Patent Publication WO 00/00557 dated Jan. 6, 2000, which is incorporated herein by reference. The eraser is made of a material which is capable of erasing the crayon marks which have been applied to paper. An eraser may include one or more of the following materials: natural rubber, synthetic rubber, vinyl, gum or silicone. One such composition for the eraser material is Krayton, Product No. G-1726 from Shell Chemical Company, P.O. Box 2463, Houston, Tex., U.S.A.

Thus, the invention provides a crayon with an eraser. The invention allows a child to use the crayon and then use the eraser to remove any unwanted markings from the paper. Since the eraser is connected to the crayon, the possibility of losing an eraser, misplacing an eraser, or not having an eraser is eliminated.

In addition, the invention also reduces the cost of making the crayon assembly. The cost of making the crayon assembly is reduced by molding the eraser and crayon in a two part molding process.

While particular embodiments of the invention have been shown, it will be understood that the invention is not limited thereto. On the contrary, we intend to cover all alternatives, modifications and equivalents as may be included within the scope of the invention as defined by appended claims. All references and copending applications cited herein are hereby incorporated by reference in their entireties.

What is claimed is:

1. A crayon assembly comprising a crayon and an eraser, the crayon has an attachment portion, the eraser being in contact with the attachment portion and molded thereto.

2. The crayon assembly as in claim 1 wherein the crayon is made of an erasable material.

3. The crayon assembly as in claim 1 wherein the eraser includes an attachment portion.

4. The crayon assembly as in claim 1 wherein the attachment portion on the crayon is a pocket, the eraser includes an attachment portion, the attachment portion on the eraser is a post.

5. The crayon assembly as in claim 4 wherein the pocket includes a recess.

6. The crayon assembly as in claim 4 wherein the pocket includes four recesses.

7. The crayon assembly as in claim 4 wherein the attachment portion on the crayon has a cross section which has a circular shape.

8. The crayon assembly as in claim 4 wherein the attachment portion on the crayon has a cross section which has a gear shape.

9. The crayon assembly as in claim 4 wherein the attachment portion on the crayon has a polygon shape.

10. The crayon assembly as in claim 1 wherein the attachment portion on the crayon is a post, the eraser includes an attachment portion, the attachment portion on the eraser is a pocket.

11. The crayon assembly as in claim 10 wherein the post has a fin.

12. The crayon assembly as in claim 10 wherein the post has four fins.

13. The crayon assembly as in claim 10 wherein the attachment portion on the crayon has a cross section which has a circular shape.

14. The crayon assembly as in claim 10 wherein the attachment portion on the crayon has a cross section which has a gear shape.

15. The crayon assembly as in claim 10 wherein the attachment portion on the crayon has a polygon shape.

16. The crayon assembly as in claim 1 wherein the attachment portion on the crayon has a cross-section which has a plus sign ("+") shape.

17. The crayon assembly as in claim 1 wherein the attachment portion on the crayon has a cross-section which has a circular shape.

18. The crayon assembly as in claim 1 wherein the attachment portion on the crayon has a cross-section which has a gear shape.

19. The crayon assembly as in claim 1 wherein the attachment portion on the crayon has a cross-section which has a polygon shape.

20. The crayon assembly as in claim 1 further comprising a label.

21. The crayon assembly as in claim 1 wherein the eraser is molded onto the crayon.

22. The crayon assembly as in claim 1 wherein the eraser is molded onto the eraser.

23. A method for producing a crayon assembly, the method comprising:

molding a crayon;

molding an eraser; and connecting the crayon to the eraser by molding, the crayon has an attachment portion, the eraser is in contact with the attachment portion.

24. The method as in claim 23 wherein the connecting step is performed by molding the eraser onto the crayon.

25. The method as in claim 23 wherein the connecting step is performed by molding the crayon onto the eraser.

26. A crayon assembly comprising a crayon and an eraser, the eraser is connected to the crayon by molding.

27. The crayon assembly as in claim 26 wherein the eraser is molded onto the crayon.

28. The crayon assembly as in claim 26 wherein the crayon is molded onto the eraser.

* * * * *

UNITED STATES PATENT AND TRADEMARK OFFICE

CERTIFICATE OF CORRECTION

PATENT NO. : 6,505,984 B2
DATED : January 14, 2003
INVENTOR(S) : Smith et al.

It is certified that error appears in the above-identified patent and that said Letters Patent is hereby corrected as shown below:

Title page,
Item [56], References Cited, U.S. PATENT DOCUMENTS, add:

| | | | |
|---|---|---|---|
| -- | 2,148,684 | Chesler | 2/1939 |
| | 2,180,132 | Zoll | 11/1939 |
| | 2,785,100 | Yaw | 3/1957 |
| | 3,704,071 | Muller et al. | 11/1972 |
| | 5,774,931 | Coinon et al. | 7/1998 -- |

Add: -- FOREIGN PATENT DOCUMENTS

| | | |
|---|---|---|
| FR 1 017 665A | Fischer | 17 Dec. 1952 -- |

Signed and Sealed this

Twentieth Day of May, 2003

JAMES E. ROGAN
*Director of the United States Patent and Trademark Office*